US011131133B2

(12) United States Patent
Terno

(10) Patent No.: US 11,131,133 B2
(45) Date of Patent: Sep. 28, 2021

(54) DEVICE FOR SLIDING OF DOORS COATED WITH INDUSTRIAL LAMINATES

(71) Applicant: TERNO SCORREVOLI S.P.A. UNIPERSONALE, Varedo (IT)

(72) Inventor: Giovanni Terno, Varedo (IT)

(73) Assignee: TERNO SCORREVOLI S.P.A. UNIPERSONALE, Varedo (IT)

( * ) Notice: Subject to any disclaimer, the term of this patent is extended or adjusted under 35 U.S.C. 154(b) by 15 days.

(21) Appl. No.: 16/478,241

(22) PCT Filed: Mar. 20, 2018

(86) PCT No.: PCT/EP2018/000103
§ 371 (c)(1),
(2) Date: Jul. 16, 2019

(87) PCT Pub. No.: WO2018/171935
PCT Pub. Date: Sep. 27, 2018

(65) Prior Publication Data

US 2019/0360247 A1 Nov. 28, 2019

(30) Foreign Application Priority Data

Mar. 22, 2017 (IT) ..... 102017000031693

(51) Int. Cl.
*E05D 13/00* (2006.01)
*E05D 15/06* (2006.01)
*E05F 5/00* (2017.01)

(52) U.S. Cl.
CPC ..... *E05D 15/063* (2013.01); *E05F 5/003* (2013.01); *E05Y 2600/46* (2013.01); *E05Y 2900/132* (2013.01)

(58) Field of Classification Search
CPC ..... E05D 15/063; E05D 15/0652; E05D 15/0647; E05D 15/0656; E05D 13/04; E05F 5/003; E05Y 2600/46; E05Y 2900/132
(Continued)

(56) References Cited

U.S. PATENT DOCUMENTS 269,508 A * 12/1882 Birmingham ..... E05D 15/063 16/106
836,952 A * 11/1906 Willour ..... E05D 15/063 16/101
(Continued)

FOREIGN PATENT DOCUMENTS

EP 312777 A1 * 9/1988
WO 2005085575 9/2005
WO 2012073215 6/2012

*Primary Examiner* — Jerry E Redman
(74) *Attorney, Agent, or Firm* — Abelman, Frayne & Schwab

(57) ABSTRACT

A device for mounting a sliding of door on a wall to enable slidable movement of the door to open and close a wall opening. The device includes a guide profile having a horizontally-orientated base forming a track, which is attached to a correspondingly horizontally-orientated upper end of the door via a fastener. The guide profile further includes an inverted U-shaped seat extending upwardly from and positioned over the base. A trolley slide is fixedly attached to the wall above the wall opening via a fastener. The trolley slide has one or more vertically-orientated rotatable wheels configured for insertion into and engagement with the inverted U-shaped seat, such that sliding movement of the door effects rotation of the wheels within the inverted U-shaped seat. A cushioned stop positioned at an end of the track is configured to contact the trolley slide to stop slidable movement of the door.

7 Claims, 3 Drawing Sheets

(58) Field of Classification Search
USPC ..... 49/409, 425
See application file for complete search history.

(56) References Cited

U.S. PATENT DOCUMENTS 1,035,064 A * 8/1912 Westlin etal. ..... 16/89
1,223,112 A * 4/1917 Rixson ..... F16C 29/04 384/49
1,414,630 A * 5/1922 Dowald ..... E05D 15/0643 16/88
1,568,270 A * 1/1926 Cross ..... E05D 15/0643 16/105
1,688,191 A * 10/1928 Kuhn ..... E05D 15/0643 16/94 R
3,425,162 A * 2/1969 Halpern ..... E05D 15/0634 49/425
3,601,926 A * 8/1971 Weiher ..... E05D 15/0643 49/409
3,975,862 A * 8/1976 Doan ..... E05D 15/08 49/409
4,404,770 A * 9/1983 Markus ..... E05D 15/1021 49/235
4,475,312 A * 10/1984 Deutschle ..... E05F 11/53 49/360
4,619,075 A * 10/1986 Wiles ..... E05D 15/1021 49/235
4,628,638 A * 12/1986 Elko ..... E05D 15/0617 248/230.5
4,723,374 A * 2/1988 Peterson ..... E06B 11/045 49/394
4,769,948 A * 9/1988 Carmichael ..... E05D 15/0652 16/94 R
5,022,185 A * 6/1991 Oatman ..... E05D 15/0617 49/404
5,070,575 A * 12/1991 Redman ..... E05D 15/0639 16/96 R
5,136,813 A * 8/1992 Gibbs ..... E05D 15/0617 49/404
5,345,723 A * 9/1994 Gibbs ..... E05D 15/0617 49/506
5,461,829 A * 10/1995 Lehto ..... E05D 15/1021 16/87 R
5,598,666 A * 2/1997 Kurth ..... A47K 3/34 4/557
5,966,879 A * 10/1999 Verbeek ..... E04B 2/7416 49/404
6,698,138 B1 * 3/2004 Lin ..... E05D 15/0639 16/105
7,568,311 B2 * 8/2009 Shivak ..... E04B 2/7455 49/409
8,297,334 B2 * 10/2012 Chu ..... E06B 9/36 160/222
8,375,645 B2 * 2/2013 Iwauchi ..... E05D 15/1042 52/29
8,381,354 B2 * 2/2013 Haab ..... E05D 15/0656 16/91
8,839,563 B2 * 9/2014 Kalempa ..... E06B 3/822 49/410
8,915,019 B2 * 12/2014 Schachter ..... E05D 5/0246 49/425
9,038,316 B2 * 5/2015 Von Gerichten ..... E05D 15/063 49/360
9,482,040 B2 * 11/2016 Pettersson ..... E05D 15/063
2002/0069588 A1 * 6/2002 Finke ..... E05D 15/0652 49/409
2002/0170234 A1 * 11/2002 Salice ..... E05D 15/063 49/453
2006/0150518 A1 * 7/2006 Van't Zelfde ..... E05D 15/0626 49/409
2006/0230684 A1 * 10/2006 Poole ..... E05D 15/0634 49/409
2008/0148643 A1 * 6/2008 Lemming ..... E05D 15/0643 49/409
2009/0126279 A1 * 5/2009 Kopish ..... E05F 5/003 49/409
2010/0242370 A1 * 9/2010 Trulaske, Sr. ..... E05D 15/0626 49/410
2011/0094162 A1 * 4/2011 Morris ..... A47H 23/04 49/409
2011/0179718 A1 * 7/2011 Martin ..... E05F 5/003 49/413
2014/0013668 A1 * 1/2014 Balbach ..... E05F 15/643 49/409

* cited by examiner

DEVICE FOR SLIDING OF DOORS COATED WITH INDUSTRIAL LAMINATES

CROSS-REFERENCE TO RELATED APPLICATIONS

This application is a National Stage application PCT/EP2018/000103 filed Mar. 20, 2018 and claiming priority of Italian application 102017000031693 filed Mar. 22, 2017, both applications are incorporated herein by reference thereto.

FIELD OF THE INVENTION

This invention relates to a device for sliding doors coated with industrial laminates. More particularly, this invention refers to a device specially suitable to the sliding movement of the wings or doors that separate two rooms and that are provided with a coat formed by industrial laminates of standard dimensions.

BACKGROUND OF THE INVENTION

As is known, the sliding doors separating two rooms are widespread and appreciated because they do not angularly orientate in the opening, occupying space, but slide parallel and adjacent to the wall on which the opening is made. For sliding doors, specific devices are used, comprising an upper guide secured to the wall for the sliding of one or more trolleys from which an appendage that is connected to the upper end of the door protrudes below; a complementary lower guide is generally integrated flush with the floor and wheels or skids connected to the lower edge of the same door slide inside it. A solution of this kind is described in the patent application EP 2 913 468 A1 of the same applicant.

EP 2 646 635, on the other hand, concerns a sliding door in which the guide and support means guarantee both a small footprint in relation to the extension of the relative doorway, and the possibility of carrying out installation and maintenance operations quickly and easily.

Furthermore, EP 1 725 729 refers to a suspension system for a sliding door, in which the sliding profile section is secured to the wall and extends in length for a dimension equal to about twice the width of the doorway to be shielded.

A known type of sliding doors provides that they are made of honeycomb and unpainted panels, are covered with a thin sheet of synthetic material or paper, suitably processed, called "lamination", reproducing the effect of wood in the various species or other decorations or colors and forming the finish of these doors. The laminate is made according to standard dimensions that influence the height of the sliding doors; this dimension is typically 2,150 mm. It follows that a door having a height of 2,100 mm can be coated with lamination with a height of 2,150 mm as a part corresponding to the remaining 50 mm remains available for processing, while this is not possible for a door with a height equal to or greater than 2,200 mm. The height of the door or wing is dictated by the height of the opening made in the wall; despite the preset measures, it often happens that the height of the finished opening is higher, albeit slightly, than the conventional height of 2,100 mm, thus making it impossible to use a sliding door coated in laminate. There is also a different size of the lamination, with a much greater height than the one specified above; however, its use in this specific sector would lead to a considerable waste of material as the doors intended for non-standardized rooms would, however, only slightly exceed the size of 2,150 mm.

The object of the present invention is to obviate the aforementioned drawbacks.

SUMMARY OF THE INVENTION

More particularly, the object of this invention is that of providing a device for sliding doors that allows to use doors coated with lamination even in the presence of a wall opening having a height greater than 2,100 mm or, in any case, a height not compatible with the corresponding size of the laminate.

A further object of the invention is to provide a device for sliding doors as defined above that allows avoiding the traditional operations necessary for lowering the door and casing the sliding profile section flush with the door.

Not least object of the invention is to provide users with a sliding device for doors that adequately and completely covers the light of the doorway made in the wall, without creating undesired anti-aesthetic effects.

A further object of the invention is to provide users with a device for sliding doors to ensure a high level of resistance and reliability over time, such as to be easily and economically manufactured.

These and other objects are achieved by the device for sliding doors coated with industrial laminates of this invention according to the main claim.

BRIEF DESCRIPTION OF THE DRAWINGS

The constructive and functional characteristics of the device for sliding doors coated with industrial laminates of this invention can be better understood from the detailed description below, in which reference is made to the attached tables of drawings representing a preferred and non-limiting embodiment thereof and in which.

DETAILED DESCRIPTION OF THE PREFERRED EMBODIMENT

Figure 1:
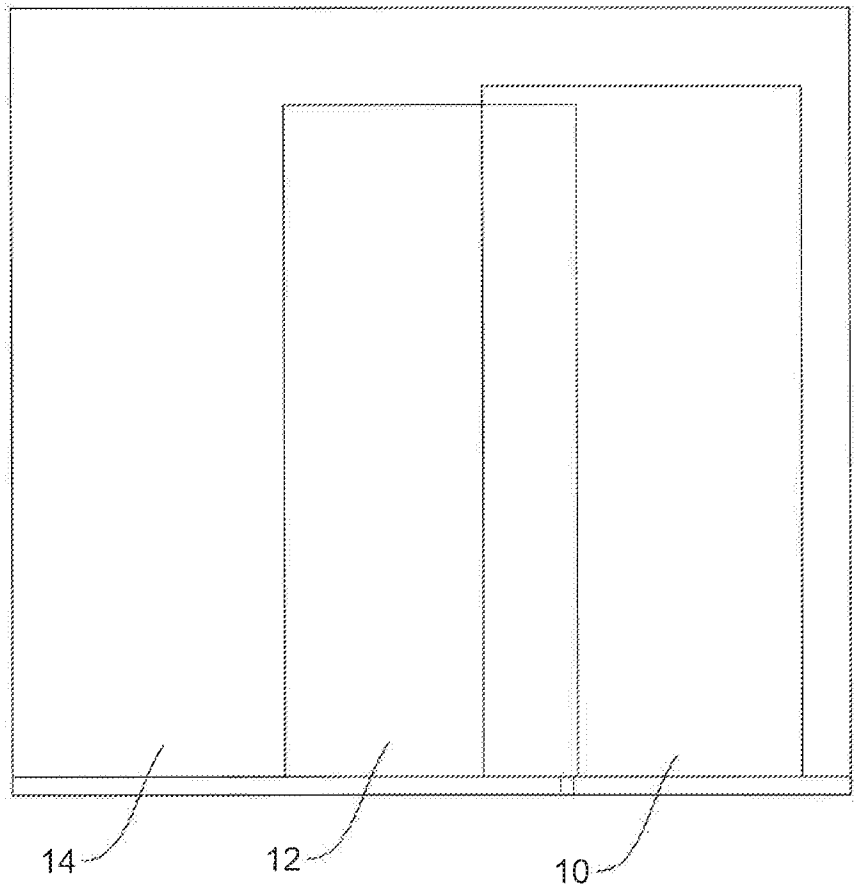
FIG. 1 (PRIOR ART)
FIG. 1 is a prior art schematic front view of the opening or passage space created in a wall and the relevant sliding door that closes the same space according to the known reference art.
Figure 2:
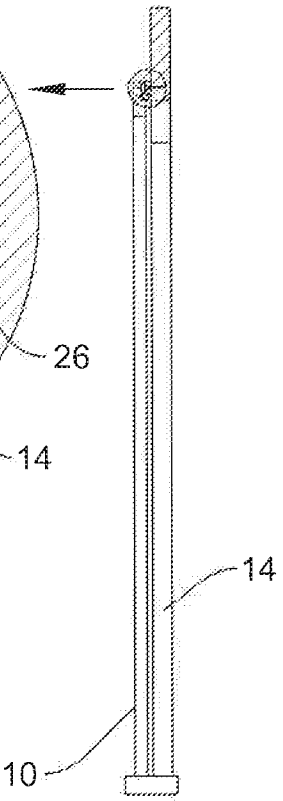
FIG. 2 (PRIOR ART)
FIG. 2 is a prior art schematic sectional view of said wall and wing according to FIG. 1.
Figure 3:
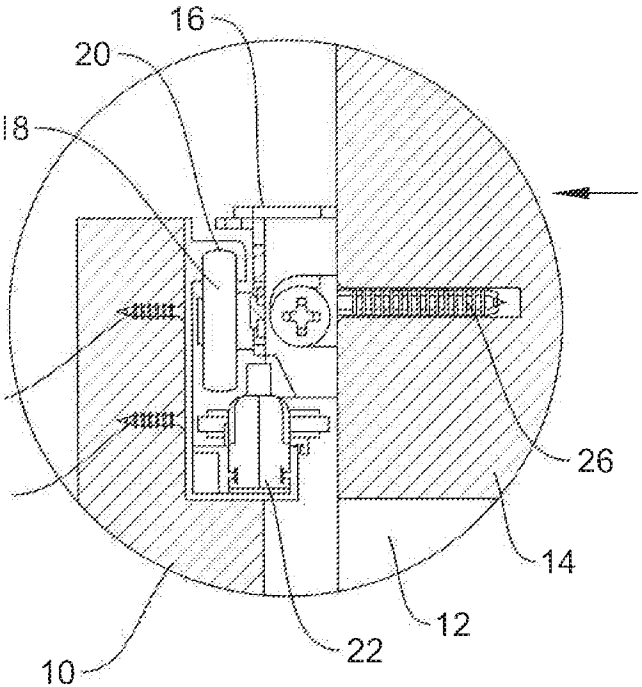
FIG. 3 (PRIOR ART)
FIG. 3 is a prior art schematic view of an enlarged detail of FIG. 2, showing the lowering created on the wing according to the traditional solution for housing the sliding profile section of the trolley.
Figure 4:
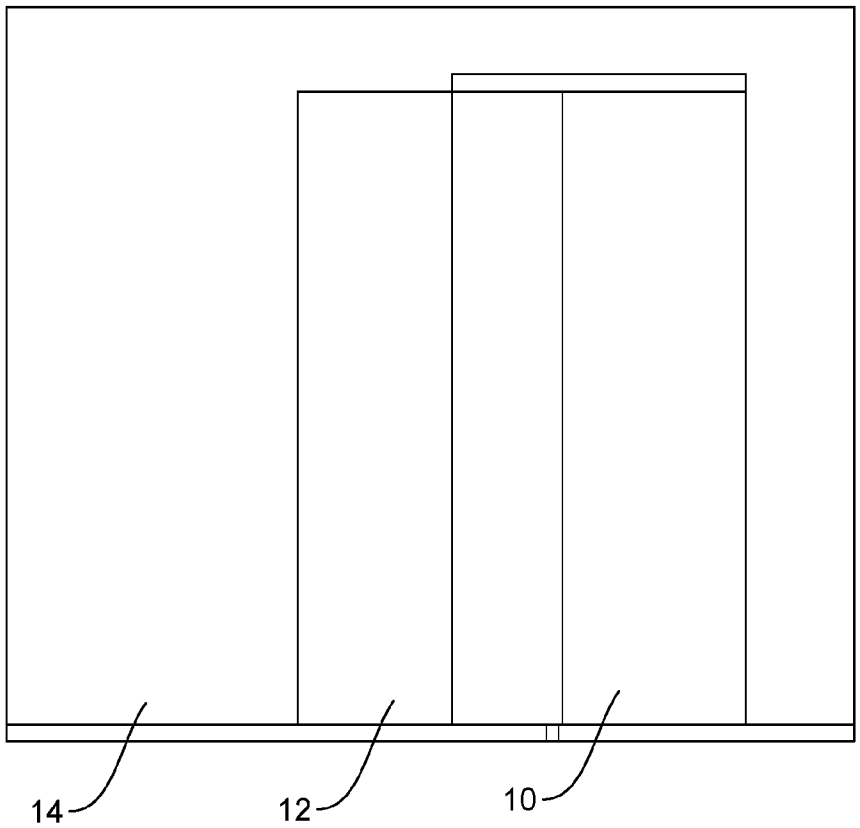
FIG. 4 is a schematic front view of the opening or passage space created in a wall and the corresponding sliding door that closes the same space according to the invention.
Figure 5:
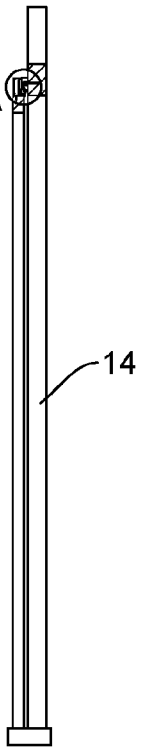
FIG. 5 is a schematic sectional view of said wall and wing according to FIG. 4.

The initial reference is to FIGS. 1 to 3, showing a solution designed by the same applicant to manufacture the sliding of a door 10, so as to lead it to temporarily close a passage space 12 created in a wall 14; it should be noted, from FIG. 1, that the door 10 can completely shield the space 12 only if it has a height at least equal, preferably higher, than that of the space. If the material with which the door 10 is coated does not reach the required height, as it does not exceed the standard size of 2,150 mm, the door with this coating cannot be used. Furthermore, with reference to FIG. 3, it should be noted that, according to the traditional solution, the door 10 must be provided with a longitudinal lowering at the upper edge, on the front facing the wall 14, so as to create the support seating for the profile section 16 in which the trolley or the trolleys with the wheels 18 run and also to avoid an excessive protrusion of the profile section with respect to said wall 14. Said profile section, as can be seen from FIG. 3, is secured laterally to the door 10, in particular, to its inner side 10', by conventional screws 24 and defines a substantially "L"-shaped section, with an upper part provided with an inverted "U"-shaped seat 20 along which the wheel 18 of the already known trolley runs; and a lower part in which at least one known cushioned stop 22 is housed; the latter gradually accompanies the door 10 when closing and/or opening at the end of its stroke. The trolley, according to this known embodiment, is secured with screws 26 or equivalent retaining means to the wall 14, above the space 12, which, in this case, is completely shielded by the door 10 whose height is higher than that of the space.

According to the invention, with particular reference to FIGS. 4 to 8 in which the same reference numerals of the known solution described above as for the same components are used, the sliding device of the door 10 comprises a guide profile section 28, located at the upper end of the door and is provided, similarly to the profile section 16, with an inverted "U"-shaped seat 20, along which the wheel 18 of the known trolley runs, and with at least one cushioned stop 22. In the lower part adjacent to the floor, the door 10 is instead driven to slide by means of a guide of a known type and with the support of skids or equivalent means.

Figure 6:
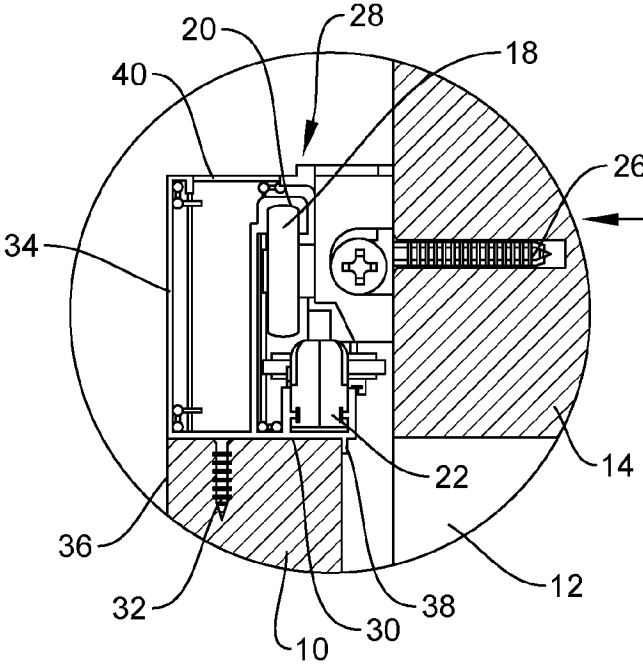
FIG. 6 is a schematic view of an enlarged detail of FIG. 5 showing the end connection between the profile section and the wing or door.
Figure 8:
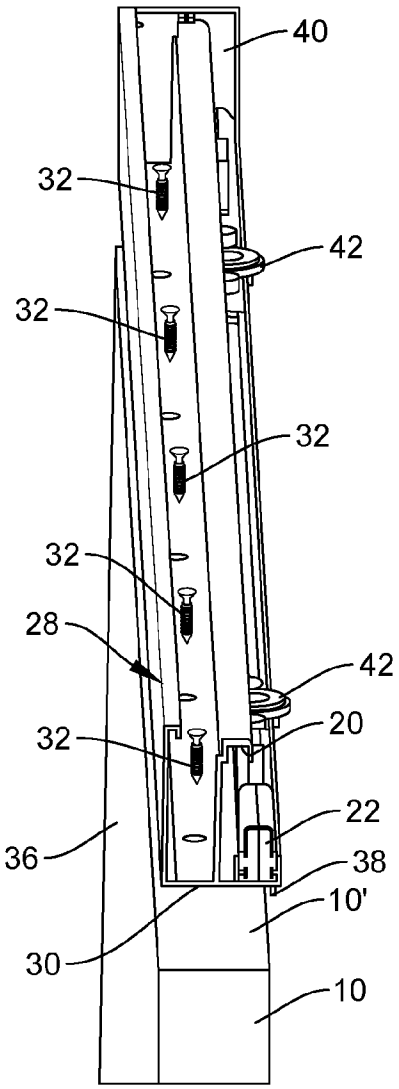
FIG. 8 is a schematic top view of the sliding device of the invention that is secured to the door.
Figure 7:
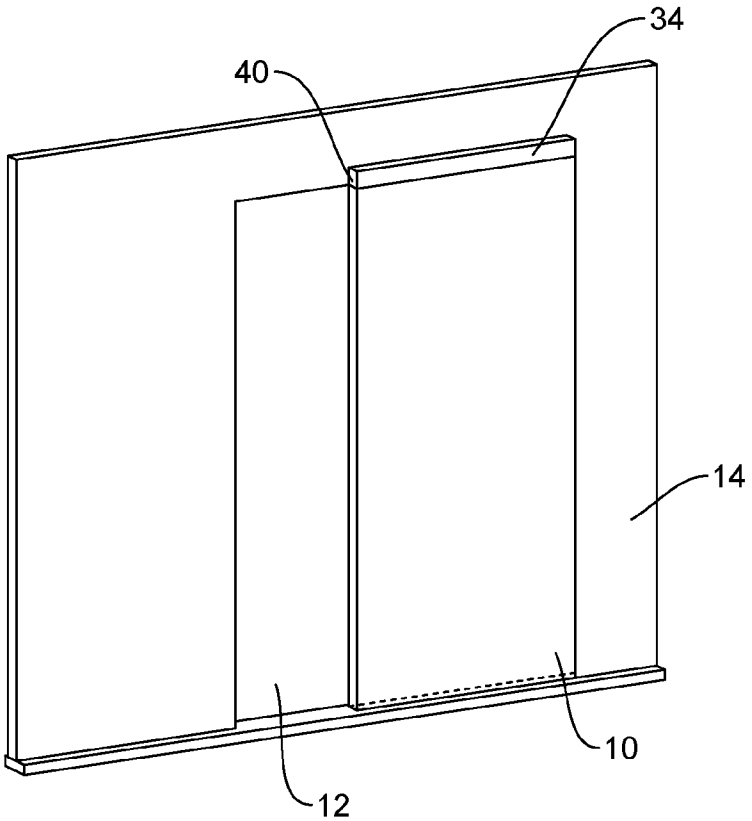
FIG. 7 is a schematic axonometric view of the wall with the space and of the sliding door according to the invention intended to close the space itself.

The support base 30 of the profile section 28, shown in detail in FIG. 6, extends in width by a dimension preferably at least equal to the depth or thickness of the wing constituting the door 10; the profile section 28 rests with said base 30 on the upper end of said door, indicated as 10' in FIG. 8, which defines this thickness. The profile section 28 is secured to the door 10 with screws 32, engaged vertically along said upper end.

At the front end opposite to the wall 14, the base 30 of the profile section 28 folds orthogonally upwards to form an integral façade 34, which aligns with the front side of the door 10, indicated as 36 in FIGS. 6 and 8. Said front side 36 of the door 10 can advantageously be provided with the coat constituted by the lamination (not shown), also in its standard dimension whose height is equal to 2,150 mm, the façade 34 is perfectly aligned with this coat, of which it visually constitutes an extension in the form of a band, having a width corresponding to that of the door 10. Said façade 34 of the profile section 28 is therefore able to shield the upper part of a space 12 having a height higher than that of the door 10 with the lamination coat, advantageously compensating this height that, in most cases, does not exceed 40 mm. The façade 34 of the profile section 28 can in any case have any dimension in height, according to the specific requirements dictated mainly by the height of the space 12; according to a preferred and not limiting embodiment, this height will however advantageously range from 50.0 to 70.0 mm.

In the opposite position with respect to the façade 34, the profile section 28 comprises a lip 38, which extends downwards towards the door 10 starting from the base 30, in particular from the area near the rear end facing the wall 14 of the base. The lip 38, with an orientation height ranging between 2.0 and 4.0 mm, is particularly visible in FIGS. 6 and 8 and acts as a stop for the profile section 28 that, thanks to it, comes into contact with the door 10, on its rear side opposite to its front side 36. On the opposite ends of the profile section 28 there is a conventional closing and finishing cap 40, visible in FIGS. 6, 7 and 8.

The façade 34 of the profile section 28 can be customized from an aesthetic point of view, so as to adapt to the lamination coat; in this sense, this façade can be painted, or the whole profile section 28 can be subjected to surface finishing treatment such as for example anodic oxidation or anodization, which makes it possible to obtain a surface with multiple colors. Said profile section 28, moreover, can be made in two independent sections, possibly connected to each other in a known manner, both secured with screws to the end of the door 10 starting from a respective area of the base 30; in this hypothesis, one of these sections could comprise, in addition to a part of the base 30, the vertical façade 34 alone.

FIG. 8 shows from above the profile section 28 under practically operating conditions, in which it is about to be permanently secured with the screws 32 to the upper end 10' of the door 10; the same FIG. 8 shows the presence of two or more rollers 42, unrelated to the solution described and claimed herein and already known, oriented horizontally and partly projecting from the profile section 28 to find the wall 14 during the door 10 opening/closing steps.

As can be seen from the foregoing the advantages that the invention achieves are evident.

The device for sliding doors coated with industrial laminates of this invention allows to use the lamination coat also on a door 10 that exceeds the standard size of the coat, equal to 2,150 mm; this is because the residual height, determined, first of all, by the off-standard height dimension of the space 12, is effectively compensated by the band formed by the vertical façade 34 of the profile section 28, extending flush with the upper edge of said door 10 provided with the lamination coat.

Even more advantageous is the possibility to easily harmonize aesthetically said façade 34 with the type and or color of the lamination coat, thanks to painting operations or by anodic oxidation surface treatments of the entire profile section 28 or of a part of it comprising the vertical façade 34.

Although the invention has been described above with reference to a possible embodiment thereof, given by way of non-limiting example, numerous changes and variations will be apparent to a person skilled in the art in light of the above description. The present invention, therefore, intends to embrace all changes and variations that fall within the spirit and in the protective scope of the following claims.

The invention claimed is:

1. A device for mounting a sliding of a door on a vertical wall through which a passage space is formed, the device enabling slidable movement of the door to selectively open and close the passage space in the wall, the device comprising:

an elongated guide profile section having a horizontally orientated support base forming a track guide, the horizontally orientated support base having a bottom surface including openings for receiving fasteners for attachment to a correspondingly horizontally orientated upper edge surface of the door via the fasteners, the guide profile section further including an inverted U-shaped seat extending upwardly from and positioned over the support base;

a trolley slide configured for fixed attachment to the vertical wall above at least a portion of the passage space via a fastener, the trolley slide having one or more vertically-orientated rotatable wheels configured for at least partial insertion into and engagement with the inverted U-shaped seat, wherein sliding movement of the door effects rotation of the one or more wheels within the inverted U-shaped seat; and a cushioned stop extending from the support base at an end of the track guide and configured to contact the trolley slide to limit slidable movement of the door.

2. The device according to claim 1, wherein the support base of the profile section extends in width by a height at least equal to a depth or thickness of the door, at a front end opposite to said wall, the support base of the profile section being bent orthogonally upwards to form an integral vertical façade that aligns with a front side of said door.

3. The device according to claim 2, wherein the vertical wall of the profile section has a height between 50.0 and 70.0 mm.

4. The device according to claim 2, wherein in an opposite rear position with respect to said vertical façade, the profile section includes a lip which extends downwardly along a rear side of the door from the support base.

5. The device according to claim 4, wherein said lip has a height between 2.0 and 4.0 mm.

6. The device according to claim 2, wherein the profile section is secured with screws to the horizontally orientated upper edge surface of the door via the support base.

7. The device according to claim 1, wherein the fasteners are screws.

* * * * *